United States Patent [19]

Eskelinen et al.

[11] Patent Number: 4,882,011

[45] Date of Patent: Nov. 21, 1989

[54] DEVICE FOR GENERATING NEGATIVE PRESSURE INSIDE A MANTLE OF A REVOLVING ROLL

[75] Inventors: Pekka Eskelinen, Karhula; Vesa Vuorinen, Turku; Seppo Rantanen, Merimasku, all of Finland

[73] Assignee: Valmet Paper Machinery Inc., Finland

[21] Appl. No.: 263,640

[22] Filed: Oct. 27, 1988

[30] Foreign Application Priority Data

Oct. 29, 1987 [FI] Finland ..... 874774

[51] Int. Cl.[4] ..... D21F 3/10

[52] U.S. Cl. ..... 162/368; 29/114; 29/121.1; 162/369; 162/372; 210/406; 210/416.1

[58] Field of Search ..... 162/363, 364, 367, 368, 162/369, 372; 29/114, 121.1; 210/402, 406, 416.1, 784, 258

[56] References Cited

U.S. PATENT DOCUMENTS 3,091,563 5/1963 Meyer ..... 162/368

3,201,309 8/1965 Stuebe et al. ..... 162/368

FOREIGN PATENT DOCUMENTS 393389 3/1974 U.S.S.R. ..... 29/114

*Primary Examiner*—Karen Hastings

*Attorney, Agent, or Firm*—Steinberg & Raskin

[57] ABSTRACT

The present invention concerns a device for generating negative pressure inside a cylindrical roll mantle of a revolving roll. The roll has a roll mantle provided with through-holes, grooves or equivalent apertures and confining a suction chamber in the interior thereof, in which a negative pressure can be generated by suctioning air out of the suction chamber. A suction flow directed towards the suction chamber thereby prevails in the holes, grooves or equivalent apertures of the roll mantle. At least one rotor blower or equivalent is attached to the roll to revolve along with the roll, with an intake side of the rotor being connected to the suction chamber of the roll. The movement of rotation of the roll thereby produces rotary movement of the rotor or equivalent, which in turn generates negative pressure in the suction chamber. Thus, in the arrangement in accordance with the present invention, external equipment of negative pressure or a separate piping system is not needed.

12 Claims, 3 Drawing Sheets

Characteristic curves
Specific gravity of air 1.23 kg/m3

Power requirement kW
2
1.5
1
0.5
0
E
800
700
600
500
400
300
A
Pressure mm H2O
50
40
30
20
10
0
A
η=0.69
B
η=0.73
C
η=0.72
D
η=0.69
E
η=0.62
800/18.9
Stat. pressure
K2
K1
700 / 16.5
r/min./m/s
(circumferential speed)
600/14.2
500 / 11.8
400/8.4
300 / 7.1
Dyn. pressure
1
2
3
4
5
6
7
Air quantity 1000 m3/h

DEVICE FOR GENERATING NEGATIVE PRESSURE INSIDE A MANTLE OF A REVOLVING ROLL

BACKGROUND OF THE INVENTION

The present invention converns a device for the generation of negative pressure inside a cylindrical roll mantle of a revolving roll. The roll comprises a roll mantle provided with through holes, grooves, or equivalent and confining a suction chamber in the interior thereof, in which negative pressure can be generated by suctioning air out of the suction chamber. A suction flow directed towards the suction chamber prevails in the holes, grooves, or equivalent of the roll mantle.

Suction rolls are needed in several locations in paper machines. For example, suction rolls are used as guide rolls for felt, wire or paper. In particular, suction rolls are indispensible in the drying section. In prior art suction rolls presently being used, the negative pressure in the suction chamber situated inside the roll mantle is generated by means of external equipment for the generation of negative pressure, which is arranged so that the equipment suctions air out of the suction chamber through a separate pipe system and thus produces negative pressure in the suction chamber.

The roll mantle is most commonly provided with holes or with grooves extending through the roll mantle, with the air entering into the suction chamber of the roll through these holes or grooves. Drawbacks of the present equipment for the generation of negative pressure are the complexity of the equipment, as well as very high requirement of power. For example, with a 9.5 m. wide press-suction roll, the required suction power is of an order of 900 kW, which causes a very high annual operating cost.

SUMMARY OF THE INVENTION

Accordingly, it is an object of the present invention to improve over the prior art equipment for generation of negative pressure.

It is a particular object of the present invention to provide a simple device for the generation of negative pressure which is permanently connected to a suction roll.

It is also an object of the present invention to reduce overall power requirement needed for generating proper negative pressure in a suction roll.

These and other objects are attained by the present invention which is directed to a device for generating negative pressure inside a substantially cylindrical roll mantle of a revolving roll comprising the roll mantle provided with through-holes grooves, or equivalent apertures and confining a suction chamber within an interior of the roll in which a negative pressure can be generated by suctioning air out of the suction chamber. A suction flow directed towards the suction chamber prevails in the holes, grooves or equivalent apertures of the roll mantle. At least one blower rotor is attached to the roll and is rotatable along with the roll, with an intake side of the rotor being connected to or communicating with the suction chamber of the roll, so that rotary movement of the roll generates rotary movement of the rotor which, in turn, generates the negative pressure in the suction chamber.

Therefore, in view of achieving the above-noted objects and other which will become apparent below, the present invention is characterized by at least one rotor blower or equivalent being attached to the roll to revolve along with the roll, with an intake side of the rotor being connected to the suction chamber of the roll so that the movement of rotation of the roll produces a movement of rotation of the rotor or equivalent, which, in turn, generates a negative pressure in the suction chamber.

A particular considered advantage of the present invention as compared with prior-art solutions is that the device of the present invention is very simple construction and of low manufacturing cost. In the present invention, the negative pressure is produced in the suction chamber of the roll by making use of the movement of rotation of the roll. In connection with the equipment of the present invention, separate and complicated pipe systems are not needed. The other advantages and characteristic features of the present invention will become apparent from the following detailed description thereof.

BRIEF DESCRIPTION OF THE DRAWINGS

The present invention will now be described in greater detail, with reference to the accompanying drawings, in which.

DESCRIPTION OF THE PREFERRED EMBODIMENTS

Figure 1:
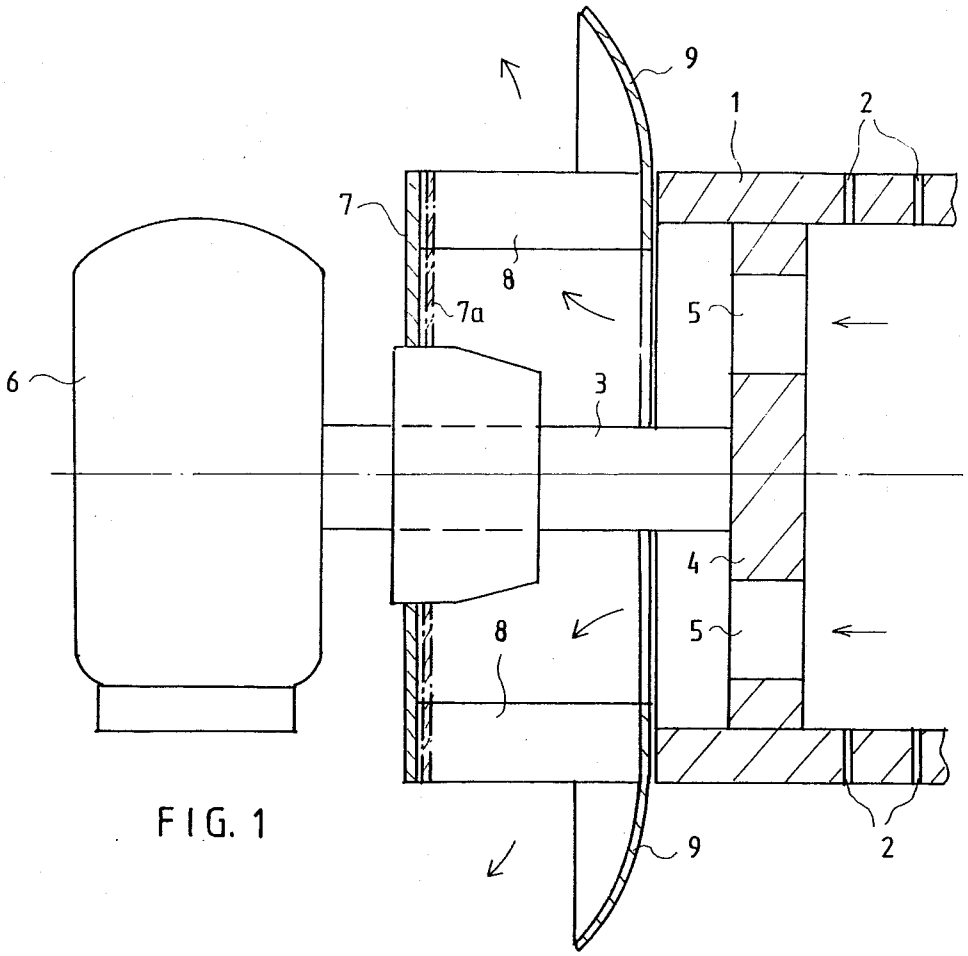
FIG. 1 is a schematic vertical sectional view of a device in accordance with the present invention.

FIG. 1 is a schematic and partial vertical sectional view of a suction roll, having a roll mantle denoted by reference numeral 1. In an ordinary manner, the roll mantle 1 is provided with holes 2, grooves, or equivalent, through which air is suctioned into a suction chamber provided inside the roll mantle 1. Negative pressure is generated in the suction chamber by suctioning air through openings 5 formed in an end 4 of the roll 1, and out of the suction chamber. A roll shaft 3 is fixed to the end 4 of the roll, with the shaft 3 being rotatably supported on a frame of the machine by means of bearing 6.

In conventional suction rolls, the roll shaft is made hollow because in these structures the negative pressure is generated in the suction chamber by suctioning air out of the suction chamber through a hole formed into the shaft itself. In contrast, in the solution provided by the present invention, it is possible to use a solid shaft 3, because the air can be suctioned out of the suction chamber through openings 5 formed into the end 4 of the roll 1. For generation of negative pressure in the embodiment illustrated in FIG. 1, a rotor blower 7 is rigidly attached to the roll shaft 3, the rotor 7 thus revolving along with the roll 1 and the roll shaft 3. The blower 7 may also naturally be attached directly to the end 4 of the roll mantle 1.

Since the rotor 7 is attached outside the roll mantle 1 in the embodiment illustrated in FIG. 1, the outer diameter of the rotor 7 may be equal to the outer diameter of the roll mantle 1 as illustrated in FIG. 1, or alternatively the outer diameter of the rotor 7 may be larger than the diameter of the roll mantle 1. The rotor 7 does not necessarily have to be surrounded by a blower casing unless the air has to be passed to some particular object at the pressure side of the rotor 7. Naturally, the rotor 7 may be provided with such a casing, or the rotor 7 may be provided with a particular guide face 9 which is attached to rotor blades 8 as illustrated in the embodiment of FIG. 1.

Figure 2:
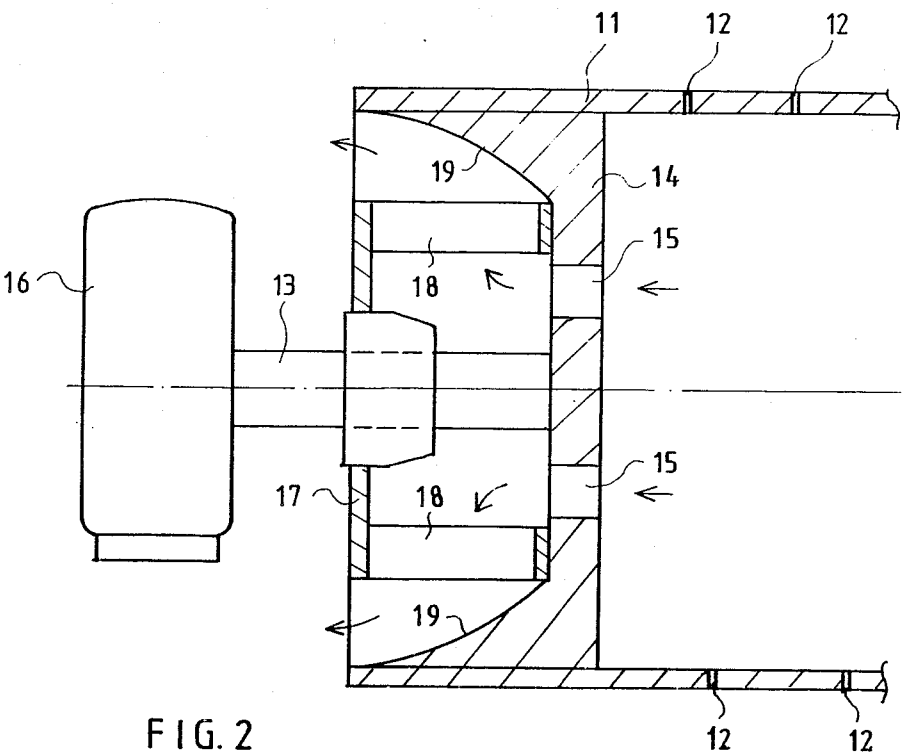
FIG. 2 is a similar view corresponding to FIG. 1, and of a second embodiment of the present inveniton.

FIG. 2 is a schematic view of a second embodiment of a device in accordance with the present invention. In FIG. 2, reference numeral 11 refers to the suction-roll mantle which is provided with holes 12, grooves or equivalent. The roll mantle 11 is attached to the roll end 14 to which a roll shaft 3 is also rigidly fixed. The shaft 13 is rotatably mounted on the frame of the machine by means of a bearing 16.

The embodiment of FIG. 2 differs from the embodiment illustrated in FIG. 1 in the following respects. In the embodiment of FIG. 2, the rotor blower 17 is not situated at the side of the roll 1; rather, the rotor 17 is attached to the roll shaft 13 and/or to the roll end 14 so that the rotor 17 is situated inside the roll mantle 11. Thus, in this embodiment as well, the rotor 17 is arranged to revolve along with the roll 1. When the roll 1 revolves, the rotor blades 18 suction air out of the suction chamber situated inside the roll mantle 11 through openings 15 formed into the roll end 14, thereby producing a negative pressure in the suction chamber in the roll mantle 11. In the embodiment in FIG. 2, a guide face 19 which is provided at a pressure side of the rotor 17 for the exhaust air, is formed in the roll end 14 itself. If required, the embodiment illustrated in FIG. 2 may also be provided with a blower casing if the flow of the air at the pressure side of the rotor 17 is intended to be directed to some particular object.

Since the requirement of negative pressure, e.g., in a suction roll increases in a linear manner when the running speed of the machine becomes higher, a solution in accordance with the present invention can be considered almost ideal, because the negative pressure generated by the rotor 7, 17 is proportional to a second power of the circumferential speed of the rotor. This means that, when the running speed of the machine becomes higher, the negative pressure generated by the rotor 7, 17 is also increased.

The device that is most suitable in accordance with the present invention for generating negative pressure, is a blower or a blower rotor that generates a maximum negative pressure at a relatively low circumferential speed. Since, in connection with suction rolls, there additionally may be a need to regulate the negative pressure in the suction chamber of a suction roll independently from the running speed of the machine, in certain cases it is advantageous to use such a blower rotor at which the quantity of air suctioned by the rotor can be adjusted, e.g., by changing the width of the rotor 7. Such an arrangement of adjustment is shown, by way of example, in FIG. 1 where a regulating disc *7a* displaceable in the axial direction is mounted on the rotor 7, by means of which the width of the rotor 7 can be adjusted.

The device in accordance with the present invention does not impose any other special requirements on the roll 1, except that the access of air through the end of the roll 1 is not prevented. In other words, there must be a sufficient number of sufficiently large openings in the end of the roll at the negative pressure side of the rotor blades. If necessary, it is naturally possible to provide a device in accordance with the present invention for the generation of negative pressure at each end of the roll.

Figure 3:
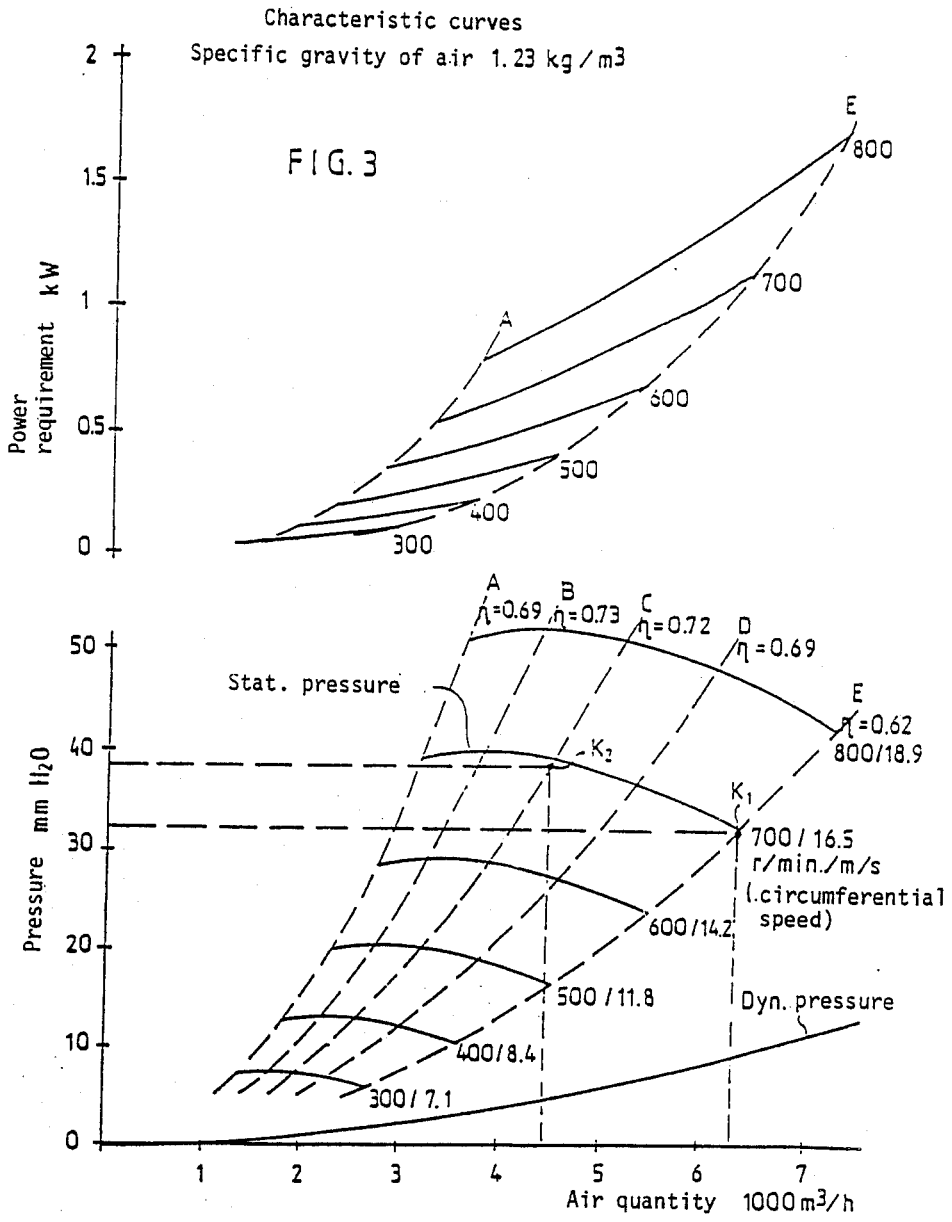
FIG. 3 illustrates, by way of example, characteristic curves of a rotor blower utilized in a device in accordance with the present invention.

FIG. 3 shows, by way of example, the characteristic curves of a rotor blower which can be used as the device in accordance with the present invention for the generation of negative pressure. The characteristic curves apply to a rotor having an outer diameter of 457 mm. The examples given in the graph of characteristic curves correspond to a situation in which the rotor is attached to a suction roll having an outer diameter of 550 mm. While the web running speed of the paper machine is 1200 m/min. This web speed corresponds to a speed of rotation of the roll and consequently of the rotor equalling 694 rpm.

The examples given in the graph of characteristic curves correspond to the very situation in which the speed of rotation of the rotor is the above 694 rpm. The point $K_1$ indicated there in the graph refers to a situation in which:

efficiency: $\eta = 0.62$ pressure: $p = 320$ PA $\approx 32.6$ mm $H_2O$ air quantity: $\dot{V} = 6200\ m^3/h = 1.72\ m^3/s$ On the other hand, the point $K_2$ refers to a situation in which:

efficiency: $\eta = 0.72$ pressure: $p = 380$ PA $\approx 38.8$ mm $H_2$ air quantity: $\dot{V} = 4500\ m^3/h = 1.25\ m^3/s$ The examples are intended to precisely illustrate the fact that the rotor herein is suitable for use as a device in accordance with the present invention for the generation of negative pressure.

The present invention has been described above by way of example and with reference to the accompanying figures. However, the present invention is not intended to be confined to just the exemplary embodiments illustrated in the figures alone. Different embodiments of the present invention may be provided, with the invention being varied within the scope of the inventive concepts set forth above.

Accordingly, the preceding description of the present invention is merely exemplary, and is not intended to limit the scope thereof in any way.

What is claimed is:

1. Device for generating negative pressure inside a substantially cylindrical mantle of a revolving roll, comprising the combination of through-holes, grooves, or equivalent apertures being provided in the roll mantle, means defining a suction chamber within an interior of the roll in which a negative pressure can be generated by suctioning air out of the suction chamber, with a suction flow being directed towards the suction chamber prevailing in the holes, grooves or equivalent apertures of the roll mantle, at least one blower rotor attached to the roll and rotatable along with the roll, an intake side of said rotor connected to or communicating with the suction chamber of the roll, said blower rotor and roll being constructed and arranged such that rotary movement of the roll generates rotary movement of said rotor which generates the negative pressure in the suction chamber, and openings provided in at least one end of the roll through which said rotor is arranged to suction air out of the suction chamber of the roll.

2. The combination of claim 1, wherein said rotor is mounted at an end of the roll.

3. The combination of claim 1, wherein said rotor is attached to the roll mantle as an axial extension of the roll.

4. The combination of claim 1, wherein said rotor is attached to a shaft of the roll.

5. The combination of claim 1, wherein said rotor is attached to an end of the roll.

6. The combination of claim 1, wherein said rotor is fitted at least partially inside the roll mantle.

7. The combination of claim 1, wherein said rotor is additionally provided with means for adjusting volumetric flow of air suctioned thereby independently from speed of rotation of the roll.

8. The combination of claim 7, wherein said means are arranged to adjust axial width of said rotor.

9. The combination of claim 8, wherein said means comprise a regulating disk mounted upon said rotor and displaceable in the axial direction.

10. The combination of claim 1, wherein said rotor is additionally provided with a guide face at a pressure side thereof, so as to guide air blown away by the rotor.

11. The combination of claim 10, wherein said guide face is attached to blades of said rotor.

12. The combination of claim 10, wherein said guide face is attached directly to an end of the roll.

* * * * *